United States Patent [19]

Howell

[11] 4,018,435

[45] Apr. 19, 1977

[54] PLAYGROUND APPARATUS

[76] Inventor: George C. Howell, P.O. Box 96, Wilder, Idaho 83676

[22] Filed: June 13, 1975

[21] Appl. No.: 586,594

[52] U.S. Cl. ..... 272/33 R; 272/38; 272/55

[51] Int. Cl.[2] ..... A63G 1/14

[58] Field of Search ..... 272/33 R, 38, 55, 49, 272/54, 31 A, 31 B

[56] References Cited

UNITED STATES PATENTS

| | | | |
|---|---|---|---|
| 1,123,653 | 1/1915 | Anderson et al. | 272/33 R |
| 1,415,831 | 5/1922 | Fredericks | 272/33 R |
| 1,450,634 | 4/1923 | Hunter | 272/49 |
| 1,599,014 | 9/1926 | Hunter | 272/33 R X |
| 1,660,139 | 2/1928 | Shellabarger | 272/49 |
| 2,076,113 | 4/1937 | Bartlett | 272/33 R |
| 2,537,399 | 1/1951 | Doris | 272/33 R |
| 3,298,685 | 1/1967 | Williams | 272/33 R |
| 3,497,210 | 2/1970 | McClinton | 272/55 |

FOREIGN PATENTS OR APPLICATIONS

| | | | |
|---|---|---|---|
| 555,737 | 3/1923 | France | 272/55 |
| 492,135 | 9/1938 | United Kingdom | 272/38 |
| 17,937 | 1889 | United Kingdom | 272/54 |
| 20,702 | 9/1903 | United Kingdom | 272/33 |
| 617,922 | 2/1949 | United Kingdom | 272/31 B |

*Primary Examiner*—Richard C. Pinkham
*Assistant Examiner*—Arnold W. Kramer
*Attorney, Agent, or Firm*—Finnegan, Henderson, Farabow & Garrett

[57] ABSTRACT

A playground apparatus for one or two occupants having an elongated member mounted for 360° rotation about a horizontal shaft in a support frame. A seat for the occupant is mounted at one end of the rotating member allowing the occupant to remain upright during rotation of the elongated member. Where the device is intended for use by a single occupant, the weight of the single occupant is counterbalanced by a variable weight at the opposite end of the rotating elongated member with the occupant propelling the device by pushing of the surface on which the apparatus rests with the legs. Where the device is intended for use by two occupants, there is a seat at each end of the elongated member.

10 Claims, 3 Drawing Figures

PLAYGROUND APPARATUS

BACKGROUND OF THE INVENTION

The present invention relates generally to playground apparatus, and specifically to a type of swing that allows either a single or two occupants to rotate 360° about a horizontal axis while remaining in an upright position.

Conventional playground swings are constructed to allow the occupant of the swing to move in a path below the axis of rotation in an arcuate path. Complete rotation about the axis of rotation for a conventional swing is impossible since the means of connecting the seat on which the occupant rests is normally flexible. Furthermore, even if enough propulsion could be provided to the occupant and the connecting means were right, the occupant would be in an inverted position at one portion of the rotation. In addition, the potential energy of the occupant is such a swing would be large enough to create a dangerously high speed of rotation if the potential energy of the occupant's position above the axis of rotation would be converted into kinetic energy by continued rotation.

Several references teach playground apparatus utilizing rigid frames that rotate 360° about a horizontal axis. Such structures normally have several bench-type seats mounted on a rigid rotating frame. One such teaching is U.S. Pat. No. 2,789,820, Walker. The Walker patent discloses a playground apparatus similar to a miniature ferris wheel where four-bench-type seats are pivotally mounted on a structure that rotates about a horizontal axis. The occupants propel this device by grasping a circular bar attached to the frame supporting the rotating structure. The circular bar is placed within convenient reach of an occupant of the seats which being pivotally mounted on the rotating structure remain upright throughout the 360° rotation. This apparatus necessarily requires at least two equally weighted occupants so the rotating structure is at least approximately balanced. A single occupant of the Walker device could not propel it by grasping the circular frame. A futher disadvantage of such a device is that a mismatch in the weights of the occupants would make propulsion of the device by the occupants physically demanding. A mismatch in weight distribution may also produce unsafe high speed rotation if the heavier portion of the occupant-laden structure is elevated to the uppermost position and allowed to rotate without restraint.

A further disadvantage of such a device is the necessity for more than one occupant. The probability of finding four children of similar weight that all want to participate in the same activity, at the same time, for the same amount of time is small. Furthermore, the probability that four children would agree on the relative positioning of the four different occupants makes it more probable that such a device would generate more discord than amusement.

U.S. Pat. No. 3,298,685, Williams, alleviates some of the shortcomings in the prior art by providing a device where a single occupant is rotated on a frame 360° about a horizontal axis of rotation counterbalanced by a weight. In this reference, a bench-type seat is pivotally mounted on one extremity of a rotating frame and the occupant of the seat propels the device by changing his center of gravity relative to the axis of rotation. A weight is mounted on the end of the rotating frame opposite the occupant. The weight is adjusted by moving the weight on a threaded shaft in relation to the axis of rotation of the rotating frame. By manipulating the position of the weight on the shaft, the occupant can counterbalance his weight to allow rotation of the device without a large gain in momentum upon rotation. This type of device is limited in appeal because of the relatively indirect method of propelling the rotating device. In contrast to the present invention, the Williams patent teaches the immobilizing of the occupants'legs while the present invention relies on the occupant propelling the device by pushing off the ground with the legs. The use of the legs for propulsion provides a more direct form of propulsion, a more exciting ride and more healthy exercise than any of the prior art devices.

SUMMARY OF THE INVENTION

In accordance with the purpose of the invention as embodied and broadly described herein, the playground apparatus of the invention comprises a support means for providing a stable base for the apparatus. The support means includes two vertical support frames that have rotatably suspended therebetween an elongated member. The member is suspended at its approximate midpoint in a manner allowing 360° rotation about a horizontal axis. On at least one end of the elongated member are means for supporting an occupant in an upright position during the 360° rotation. The occupant-supporting means allow the occupant or occupants to propel the elongated member in its rotation about the horizontal axis by the occupant pushing with their legs against the surface on which the apparatus rests. The opposite end of the elongated member includes means for approximately balancing the member.

Preferably there are occupant-supporting means on each end of the elongated member when the invention is intended for two occupants.

When the invention is intended for a single occupant, it is preferred that the elongated member have a variable weight container on the end of the member opposite the occupant-supporting means for counterbalancing the weight of the occupant.

Preferably, the container is disposed to contain liquids and is rotatably suspended at one end of the elongated member.

It is also preferred that the support means comprise a pair of triangular vertical support frames having a horizontal shaft at the upper apex of the triangle to which the elongated member is rotatably suspended.

BRIEF DESCRIPTION OF THE DRAWINGS

The invention consists in the novel parts, constructions, arrangements, combinations and improvements shown and described. The accompanying drawings which are incorporated in and constitute a part of this specification serve to explain the principles of the invention.

Of the Drawings.

DETAILED DESCRIPTION OF THE INVENTION

Reference will now be made in detail to the present preferred embodiment of the invention, an example of which is illustrated in the accompanying drawings.

Figure 1:
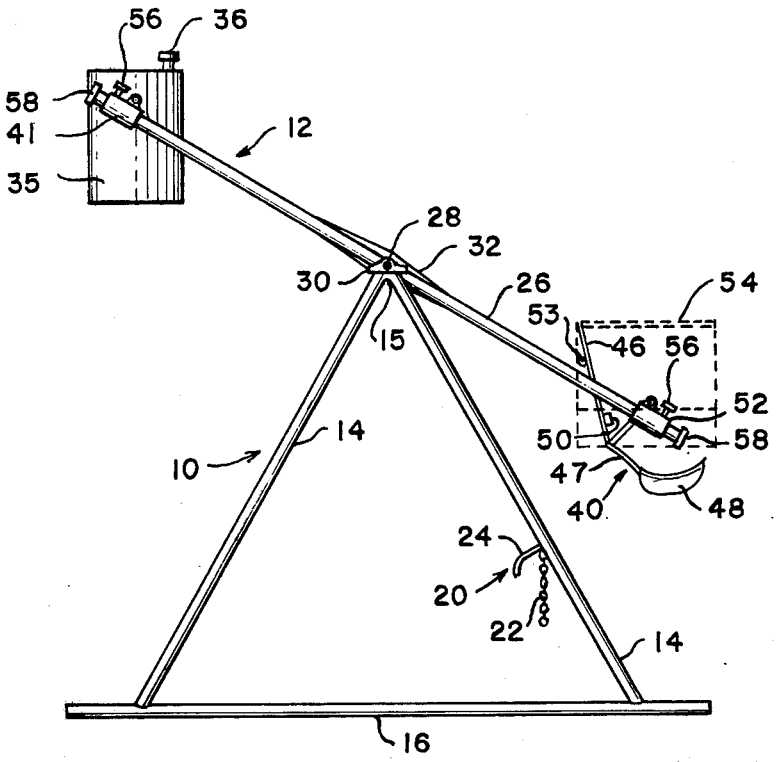
FIG. 1 is a side view of the playground apparatus constructed in accordance with the teachings of the invention where a single occupant is counterbalanced with a variable weight container.
Figure 2:
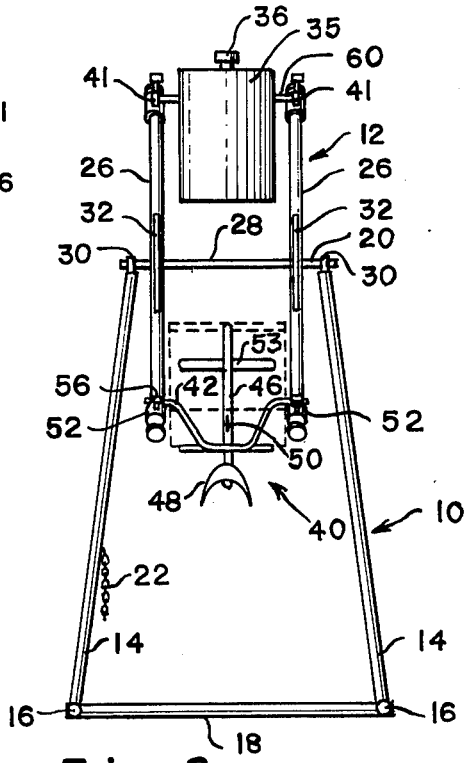
FIG. 2 is an end view of the embodiment depicted in FIG. 1.

Referring now to FIGS. 1 and 2, it may be seen that the playground apparatus includes a support means 10 and and elongated member 12 disposed to rotate 360° about a horizontal axis of rotation.

In accordance with the invention, a support means including two vertical support frames is provided to give the apparatus a stable base when placed on a relatively flat surface.

As here embodied and depicted in FIGS. 1 and 2, the support means 10 comprises a pair of vertical support frames 14 having at the upper apex 15 of the triangles a horizontal main shaft 28 to which the elongated member 12 is rotatably suspended. The vertical support frames 14 separate the horizontal axis of rotation of the elongated member 12 from the surface on which the apparatus rests to allow 360° rotation of the elongated member about the horizontal axis. Preferably, the vertical support frames 14 are affixed to a plurality of horizontal base members depicted in FIGS. 1 and 2 as members 16 and 18 that contact the surface on which the apparatus rests.

The means for supporting the invention should be strong enough to withstand the structural loads imposed on it and provide a stable, safe support for the rotating member.

In the embodiment shown, there is provided an example of a support structure that is relatively simple in construction, strong, light and stable. If such a structure was constructed of standard tubular materials, the base structure would be relatively inexpensive to manufacture.

In accordance with the invention, an elongated member is rotatably suspended between vertical support frames allowing 360° rotation of the member about a horizontal axis at the approximate midpoint of the elongated member. As here embodied, the elongated member 12 is comprised of two tubular members 26 spacially separated and affixed to the main shaft 28 which allows the rotation of the elongated member 12 about a horizontal axis of rotation 360° in either direction.

As here embodied, the main shaft includes two bearings 30 through which the main shaft 28 passes with the main shaft being affixed to the tubular members 26. The tubular members 26 could alternatively have a bearing (not shown) affixed thereto with a shaft passing through the bearings with the shaft rigidly affixed to the support 10. The main shaft is intended to provide a relatively friction-less horizontal axis of rotation for the rotating frame 12.

Preferably, the tubular members 26 include reinforcing means that prevent bending due to the structural loading of the tubular members 26. As here embodied, the reinforcing means comprise triangular braces 32. The triangular braces 32 are affixed to the tubular members 26 adjacent their midpoints to compensate for any weakening of the tubular members 26 due to the passage of the main shaft 28 therethrough.

Preferably, the apparatus includes a means for immobilizing the rotating frame 12 relative to the support structure 10 to allow an occupant of the device to mount and dismount without the elongated member moving due to the imbalance created by removing weight from one end of the elongated member. As here embodied, the immobilizing means generally 20 comprise a chain 22 and a hook 24 affixed to the support 10 on one vertical support member 14.

It is also preferred that the elongated member 12 be capable of being stopped and immobilized with the occupant adjacent the surface on which the support structure 10 rests thereby allowing convenient and safe mounting or dismounting of the occupant of the seat.

The immobilizing means should be simple enough to allow an immature occupant to immobilize the seat adjacent the surface on which the apparatus rests. The immobilizing means depicted in FIGS. 1 and 2 are merely illustrative. When one tubular member 26 of the elongated member 12 is adjacent the vertical frame member 14, the chain 22 is passed around the member 26 and affixed to the hook 24. Since the unoccupied device utilizing the variable weight container possesses a large amount of potential energy that could be dangerous if released, the immobilizing means 20 may include a security device such as a lock (not shown). In that manner, the owner may limit access to the device.

In accordance with the invention, means of supporting an occupant are provided at at least one end of the elongated member 12. The occupant-supporting means allow the occupant to remain upright during the rotation of the elongated member 12 and allow the occupant to propel the elongated member about the horizontal axis by pushing with his or her legs against the surface on which the apparatus rests.

As here embodied, the occupant-supporting means 40 comprises a seat support shaft 42 that is suspended between an opposite pair of bearing support members 52. A generally vertical seat support member 46 is affixed to the seat support shaft 42. The seat support member 46 provides means for affixing various seats to the occupant-supporting means. Preferably the seat support member 46 includes a substantially horizontal seat mounted 47 with a saddle-type seat 48 affixed thereto.

Figure 3:
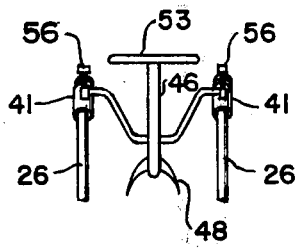
FIG. 3 is a fragmented frontal view of one embodiment of an occupant-supporting means utilizing a saddle-type seat.

A saddle-type seat is preferred since such a structure is simple, easily mounted and provides the freedom of movement of the occupants' legs to allow propulsion of the elongated member 12. A frontal view of such an embodiment is depicted in FIG. 3.

It is also preferred that the occupant-supporting means include provision for safety equipment. As depicted in FIGS. 1 and 2, the seat support member 46 may include means of attaching a seat belt (not shown) thereto. The means depicted is simply a loop 50 affixed to the seat support member 46. The occupant-supporting means may also include a protective screen. As depicted in FIG. 1, a screen 54 that partially surrounds an occupant of the seat 48 is shown. The vertical seat support 46 may also provide a handhold for the occupant, an example of which is depicted as horizontal bar 53 in FIGS. 1 and 2.

Where the invention is intended to be utilized by two occupants, then occupant-supporting means are placed at each end of the elongated member 12. In that manner, occupant-supporting means would balance the elongated member 12.

The occupant-supporting means 40 as here embodied may be placed at either extremity of the tubular members 26. Preferably both occupant-supporting means would be rotationally mounted to a bearing support member 52. The bearing support members 52 being slideably mounted to the tubular members 26 and selectively locked thereto allows the elongated member 12 to be balanced by changing the positions of the occupants in relation to the horizontal axis of rotation.

In accordance with the invention, in an embodiment for use by a single occupant a variable weight container is provided at the end of the elongated member 12 for approximately counterbalancing the weight placed on the occupant-supporting means 40.

As here embodied, the variable weight container comprises a cylindrical container 35 having a spout 36 that is conveniently placed to provide an inlet and outlet means for the container.

As embodied in FIGS. 1 and 2, the container 35 is rotatably suspended on one extremity of the elongated member 12. The container rotates about a shaft 60 above the center of gravity of the container 35. The container 35 encloses and contains materials to counterbalance weight placed at the opposite end of the rotating frame 12 and provides a convenient means of adjusting the weight counterbalancing that of the occupant.

The size of the container and the density of the material placed therein will determine the amount of weight on the occupant-supporting means that can be balanced by the variable weight container 35. The most convenient material to use in the container 35 would be water since it is plentiful, inexpensive and relatively heavy, having a density of about 62 pounds per cubit food. Other materials could also be used to provide weight to the container as for example sand. There is no necessity for exactly balancing the elongated member and a mismatch in balance will not make the device inoperable. If the occupant is heavier than the weight of the counterbalance, it merely requires more effort in propulsion for the heavier occupant to rotate the device 360°. The adjustment of the counterbalancing weight may also be changed by changing the position of the container or the occupant in relation to the main shaft 28. The container will counterbalance the largest weight when placed as far from the main shaft 28 as the elongated member 12 will permit.

As here embodied, the elongated member 12 is comprised of two parallel tubular members 26. At each end of the members 26 there are preferably a pair of bearing support members, here depicted as 52 and 41. The bearing support members are slideably engaged on the tubular members and selectively locked thereto.

As here embodied, the bearing support members are locked to the rotating frame by means of a threaded member 56 passing through the bearing support members 52 and 41 and engaging the elongated members 26 therein. In this manner, the relative positions of two opposite seat structures 40 or the seat structure 40 and the container 35 can be varied to provide a balance independent of the amount of material within the container. The closer either the container or the occupant-supporting means are to the main shaft 28, the smaller is the moment applied to the elongated member 12 about the main shaft 28.

The locking means disclosed provide only an illustration of a possible locking means. The occupant-supporting means may be affixed to the rotating frame in a manner eliminating the possibility of it sliding unexpectedly on the elongated member. It is preferred if the occupant-support means and/or the variable weight container are slideably mounted on the elongated member 12 that means be provided to prevent them from sliding completely off the extremities of the elongated member. One means of preventing such an occurrence is depicted in FIG. 1 where the extremities of the tubular members 26 have caps 58 affixed thereon. Caps 58 prevent the bearing support members from sliding off tubular members 26.

The embodiment disclosed herein provides a simple playground apparatus that provides complete rotation of the occupant or occupants about the horizontal axis. It will be apparent to those skilled in the art that various modifications and variations can be made in the apparatus of the invention without departing from the scope of the invention as defined by the appended claims.

What is claimed is:

1. A playground apparatus comprising:

a. support means for placement on a substantially flat surface, including two vertical support frames, said support means providing a stable base for said apparatus;

b. an elongated member rotatably suspended between said vertical support frames allowing 360° rotation of said elongated member about a horizontal axis at the approximate midpoint of said member;

c. means for supporting occupant in an upright position on one end of said elongated member during said 360° rotation, said occupant supporting means comprising a seat support shaft suspended on said elongated member with a generally vertical seat support member affixed to said seat support shaft, said seat support member including a substantially horizontal seat mount having a saddle-type seat affixed thereto, said occupant supporting means allowing said occupant to propel said elongated member about said horizontal axis by pushing against said surface with the occupant's legs; and d. a variable weight container means rotatably suspended at the other end of said elongated member, said container means being disposed to rotate 360° about a horizontal axis with the axis of rotation of said container means being above the center of gravity of said container means, said container being disposed to contain materials therein for approximately balancing said elongated member.

2. The apparatus of claim 1 wherein said elongated member comprises a pair of parallel tubular members, including bearing-support members slideably engaged on said tubular members and selectively locked thereto, said bearing-support members including bearings on which said container and said occupant-supporting means rotate respectively.

3. The apparatus of claim 1 wherein said support means comprises a pair of triangular vertical support frames having at the upper apex of the triangle a horizontal main shaft to which said elongated member is rotatably suspended.

4. The apparatus of claim 3 wherein said triangular vertical support frames are affixed to a plurality of horizontal base members, said base members contacting said substantially flat surface.

5. The apparatus of claim 1 wherein said seat support member includes means of attaching a seat belt thereto.

6. The apparatus of claim 1 wherein said occupant-supporting means includes a protective screen at least partially surrounding said occupant, said screen being connected to said vertical seat support member.

7. The apparatus of claim 1 including means for immobilizing said elongated member with said occupant adjacent said flat surface thereby allowing said occupant to safely mount or dismount said occupant-supporting means.

8. The apparatus of claim 7 wherein said immobilizing means comprise means for attaching said elongated member to one of said vertical support frames.

9. The apparatus of claim 1 wherein said material within said variable weight container is water.

10. The apparatus of claim 1 wherein said occupant supporting means includes a horizontal hand-hold affixed to said vertical seat support member above said seat support shaft, said horizontal hand-hold being disposed to be grasped by the occupant of said apparatus.

* * * * *